US006983866B2

(12) United States Patent
Smart et al.

(10) Patent No.: US 6,983,866 B2
(45) Date of Patent: Jan. 10, 2006

(54) LIQUID SOAP DISPENSING BATH BRUSH

(76) Inventors: Tracy Smart, 1498 Lavista Proper, Decatur, GA (US) 30033; Chris Sticht, 555 W. Madison St. #3711, Chicago, IL (US) 60661

( * ) Notice: Subject to any disclaimer, the term of this patent is extended or adjusted under 35 U.S.C. 154(b) by 0 days.

(21) Appl. No.: 10/349,296

(22) Filed: Jan. 22, 2003

(65) Prior Publication Data

US 2004/0140326 A1 Jul. 22, 2004

(51) Int. Cl.
*B67D 1/07* (2006.01)

(52) U.S. Cl. ..... 222/192; 222/385; 222/481.5; 15/104.94; 401/188 R; 401/270; 401/276

(58) Field of Classification Search ..... 222/192, 222/385, 383.1, 352, 496, 481.5, 323; 401/188 R, 401/205, 151, 270, 276, 291; 15/111, 164, 15/104.93, 104.94
See application file for complete search history.

(56) References Cited

U.S. PATENT DOCUMENTS 2,772,430 A * 12/1956 Moritt ..... 401/151
4,685,819 A * 8/1987 Endo ..... 401/176
4,829,622 A * 5/1989 O'Sullivan ..... 15/209.1
5,393,153 A * 2/1995 Bouthillier et al. ..... 401/146
5,502,863 A * 4/1996 Perkins ..... 15/227
5,536,095 A * 7/1996 Diamond ..... 401/146
5,871,297 A * 2/1999 Rogers et al. ..... 401/146
5,931,591 A * 8/1999 McCracken ..... 401/6
5,933,909 A * 8/1999 Keating ..... 15/244.1
5,944,032 A * 8/1999 Masterson ..... 132/290
6,039,489 A * 3/2000 Harman et al. ..... 401/146
6,152,635 A * 11/2000 Wu ..... 401/270
6,210,057 B1 * 4/2001 Yannaci et al. ..... 401/6
6,439,790 B1 * 8/2002 Kay ..... 401/149
6,536,970 B2 * 3/2003 Hauser et al. ..... 401/6
6,601,259 B2 * 8/2003 Chang ..... 15/209.1
6,726,385 B1 * 4/2004 Borowski ..... 401/6

* cited by examiner

*Primary Examiner*—Frederick C. Nicolas
(74) *Attorney, Agent, or Firm*—Thrasher Associates

(57) ABSTRACT

The invention provides a soap dispenser. In general, the soap dispenser includes a handle having a hollow interior, and a coupling on a first end of the handle. The first end of the handle also has a fluid passage for transferring a fluid from the hollow interior to outside the hollow interior. The coupling is adapted to receive a soft attachment having a coupling member.

16 Claims, 4 Drawing Sheets

LIQUID SOAP DISPENSING BATH BRUSH

TECHNICAL FIELD

Generally, the invention relates to devices used to bathe, and more particularly, the invention relates to devices that dispense soap.

STATEMENT OF A PROBLEM ADDRESSED BY THIS INVENTION

Bathing has been a ritual since the earliest days of the Egyptian Pharos. Even the 5000-year-old Temple of Karnack in Thebes, Egypt, was constructed about a bathing facility. Today, bathing is not only associated with ritual, but with cleanliness and hygienics. For example, some skin diseases, such as athletes'-foot type fungal infections, become worse and are transmitted due to a lack of cleanliness. In fact, some skin diseases, such as poison ivy infections, are treated via normal bathing. Regarding cleanliness, who enjoys being in the presence of someone who has not properly bathed? Accordingly, there are many motivations to bathe regularly.

Proper bathing typically requires the application of soap (or some other cleanser or disinfectant) to the person being bathed, and it is also preferred to apply the soap to the entire body. Unfortunately, persons frequently apply soap haphazardly to their body, and frequently cannot reach all of their body—particularly areas of the back. For some individuals, the application of soap to the entire body is physically difficult or even impossible. In addition, the effort it takes to continually pick up a dropped bar of soap, or to replenish soap in a washcloth, may result in the failure to apply soap as needed. In less medically severe circumstances, one may simply wish to have a better way to more conveniently and easily completely lather with soap. Accordingly, to overcome these and other disadvantages associated with existing methods of applying soap, it would be advantageous to provide a device that is easily manipulated to apply soap to all areas of a body, and to provide a device that reliably supplies soap or some other desired skin application. The present invention provides such a device.

SELECTED OVERVIEW OF SELECTED EMBODIMENTS

The present invention provides technical advantages as a soap dispenser that includes a handle having a hollow interior, and a coupling on a first end of the handle for attaching a soft attachment thereto. The first end also has a fluid passage for transferring a fluid from the hollow interior to outside the hollow interior. The coupling is adapted to receive coupling member of a soft attachment, such as a pouf, a loofah, a sponge, or soft bristles, for example. Accordingly, the length and shape of the handle are designable to enable a bather (of course, also meaning a person taking a wet or dry shower) to soap all areas of his or her body with a constant application of soap (or other fluid) without the distraction of dropping soap, or the need to reapply soap to some soap delivery platform, such as a washcloth.

Of course, other features and embodiments of the invention will be apparent to those of ordinary skill in the art. After reading the specification, and the detailed description of the exemplary embodiment, these persons will recognize that similar results can be achieved in not dissimilar ways. Accordingly, the detailed description is provided as an example of the best mode of the invention, and it should be understood that the invention is not limited by the detailed description. Accordingly, the invention should be read as being limited only by the claims.

BRIEF DESCRIPTION OF THE DRAWINGS

Various aspects of the invention, as well as an embodiment, are better understood by reference to the following EXEMPLARY EMBODIMENT OF A BEST MODE. To better understand the invention, the EXEMPLARY EMBODIMENT OF A BEST MODE should be read in conjunction with the drawings in which.

AN EXEMPLARY EMBODIMENT OF A BEST MODE

Figure 1:
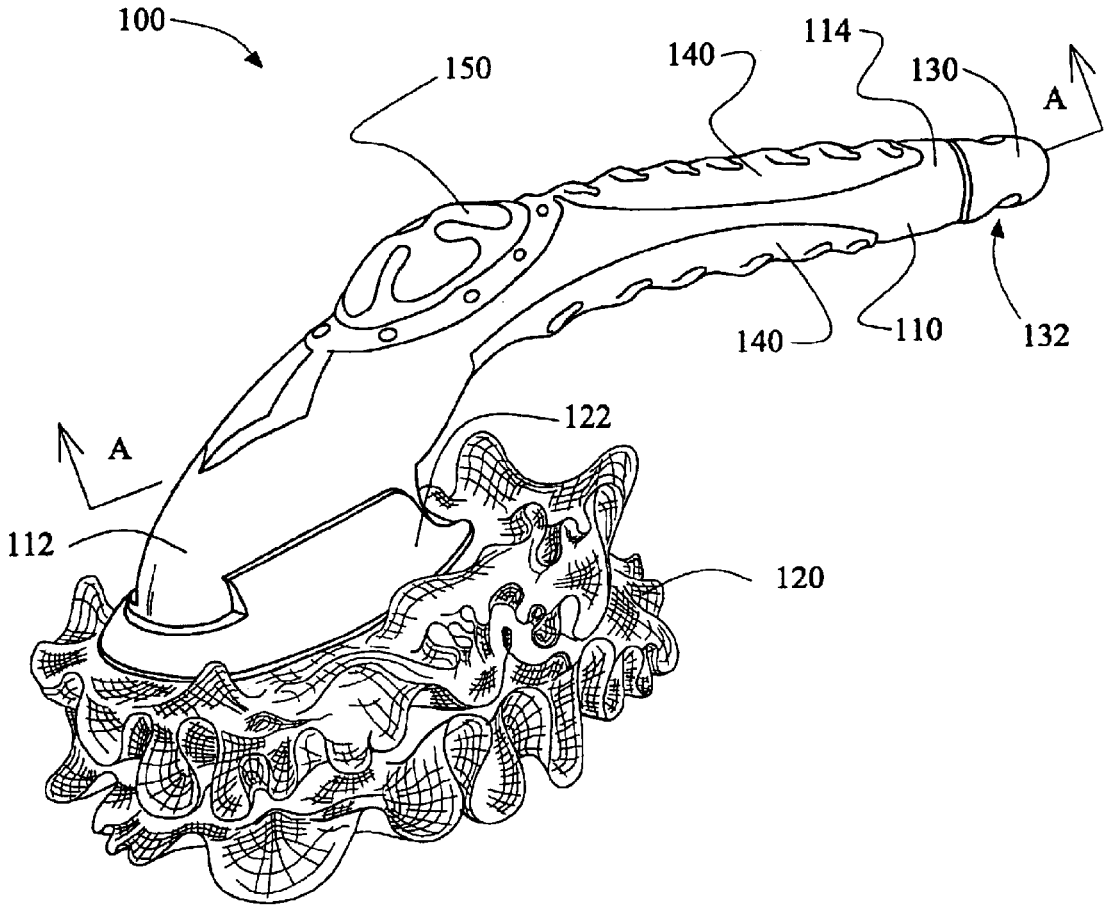
FIG. 1 illustrates a soap dispenser configured according to the invention.

Many people enjoy the feeling a shower with an exfoliating soap applicator, such as a loofah. Other persons appreciate water conservation that is achieved by using a sponge to take a shower. Others enjoy the lather that can be produced by a sponge, loofah, or "pouf." All of these persons would benefit from an invention that allows them to lather better and shower more quickly. Accordingly, the invention is a soap dispenser for use with a soft soap applicator, such as a loofah, sponge, pouf, or a bristle brush. In general, the soap dispenser includes a handle having a hollow interior that is attachable to a soft soap applicator (or "soft attachment") via a coupling on a first end of the handle. The coupling is adapted to receive a coupling member maintained on the soft attachment. The first end of the handle also has a fluid passage for transferring a fluid from the hollow interior to outside the hollow interior.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching"). Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for—functioning" or "step for—functioning" in the Claims section.

Description of the Figures

Better understanding of the invention may be gained by examining the drawings, in which FIG. 1 illustrates a soap dispenser 100 configured according to the invention. Generally, the soap dispenser 100 includes a handle 110 having a hollow interior, and a coupling 116 (not shown) on a first end 112 of the handle 110. A coupling is any component either integral with or attached to the handle 110 that enables a soft attachment to couple to the handle 110. Accordingly, the coupling 116 is adapted to receive a soft attachment 120, such as a pouf, soft bristles, body sponge, or loofah (shown), for example, via a coupling member 122.

A coupling member is any component integrally formed with or attached to a soft member, and that is also attachable to a coupling of a handle. The coupling member 122 of the soft attachment 120 is adapted to mount onto the coupling 116 of the handle 110 (the soft attachment 120 being attached to the coupling member 122). Although not viewable in FIG. 1 the coupling member 122 is adapted to slide and lock onto, and to unlock and slide off of the coupling 116. Accordingly, the coupling 116 can be said to have a flaring-lip that is adapted to accept the coupling member 122.

Also illustrated in FIG. 1 is a cap 130 on a second end 114 of the handle 110. The cap 130 is removable (such as by screw-action or snap-on) to allow a user to fill the hollow interior of the handle with a fluid such as liquid soap. Although not completely viewable in FIG. 1, the cap 130 has a notch 132 which allows the soap dispenser 110 to hang from a hook. In addition, the handle 100 preferably has a grip 140 that at least partially covers an exterior portion of the handle 110. Although other materials may be chosen, in a preferred embodiment the grip 140 is a rubber grip. Furthermore, a button 150 protrudes through the handle 110. The button 150 is preferably a rubber button 150, and by pressing the button 150 a user may dispense a liquid into the soft attachment 120.

Figure 2:
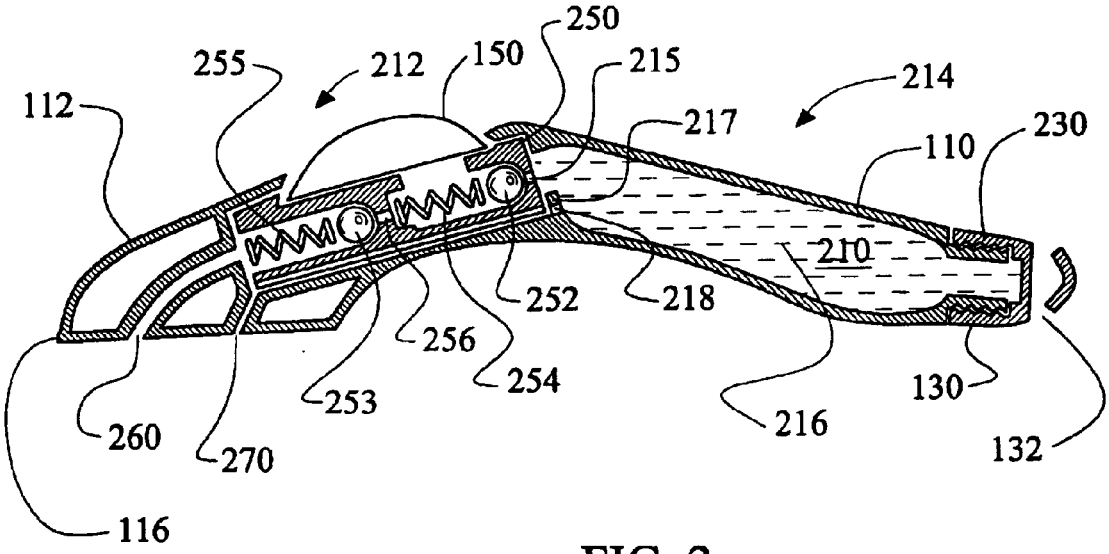
FIG. 2 is an interior view of the soap dispenser of FIG. 1 taken along cut line A—A.

FIG. 2 is an interior view of the soap dispenser of FIG. 1 taken along cut line A—A. From this view, one can see that the handle 110 has a hollow interior portion 210. In one embodiment (not shown), the hollow interior portion of the handle is detachable from the rest of the handle so that various liquids may be provided pre-loaded into a hollow handle portion. In addition, the cap 130 is also seen as being coupled to the handle via screw threads 230.

The hollow interior 210 of the handle 110 has a first end 212 and a second end 214. The hollow interior 210 maintains a first valve 215 that separates the hollow interior 210 into a fluid portion 216 at the second end 214, and a pump chamber 250 at the first end 212. The first valve 215 allows fluid to traverse from the fluid portion 216 into the pump chamber 250.

Figure 3:
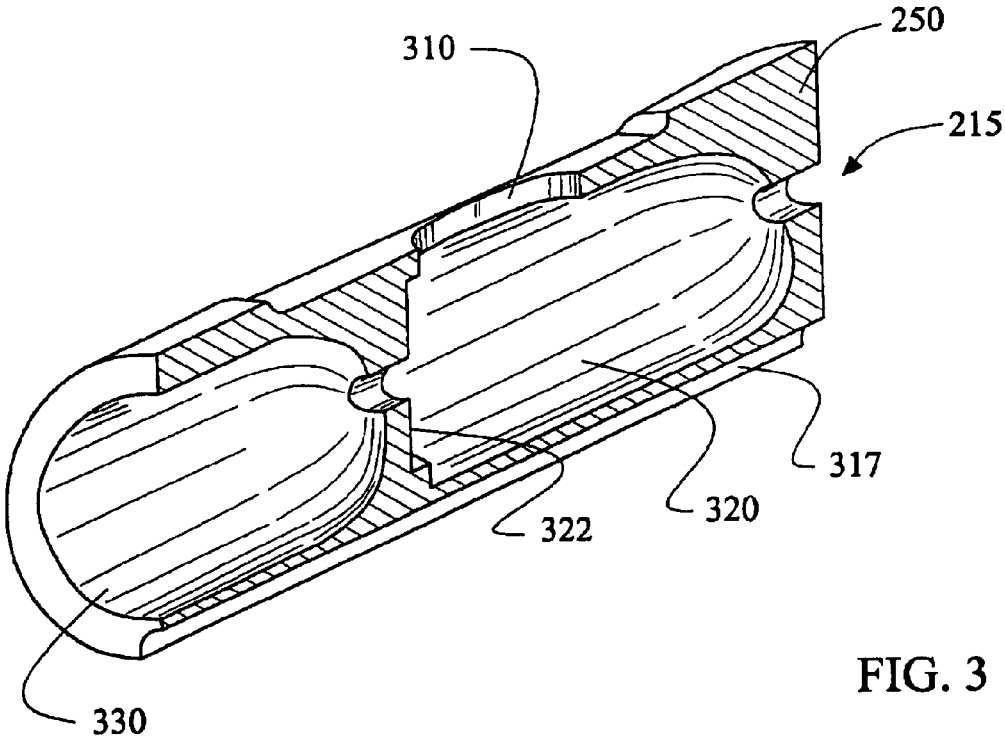
FIG. 3 is a close up of the chambers of the pump chamber.

Referring briefly to FIGS. 2 and 3 where FIG. 3 is a close up of the chambers of the pump chamber 250, a second valve 256 separates the pump chamber 250 into a first pump cylinder 320 and a second pump cylinder 330. The first pump cylinder 320 is preferably arched at the first valve 315 so that the first valve 215 may function as a one-way valve via a ball-stop 252 that maintains a predefined pressure against the valve 215 via a first spring 254. A base 322 in the first chamber 320 functions as a spring seat for the first spring 254. Similarly, the second pump cylinder 330 is preferably arched toward the second valve 256 so that the second valve 256 may function as a one-way valve via a second ball-stop 253 that maintains a predefined pressure range against the second valve 256 via a second first spring 255. The structure of the handle itself functions as a spring seat for the second spring 255.

The first pump cylinder 320 has a button opening 310. The button opening allows fluid to flow into the button 150 so that as the button 150 is depressed, fluid pressure in the first pump cylinder 320 increases. This increase in fluid pressure secures the first ball-stop 252 to the first valve 215 preventing the fluid from flowing back into the hollow portion of the handle 216. The increase in pressure also forces the second ball-stop 253 to dislodge from the second valve 256, thus allowing fluid to flow into the second pump cylinder 330. Since the second pump cylinder 330 is in fluid communication with an exit passage 260, fluid may freely flow from the second pump cylinder 300, through the exit passage 260 and into a soft attachment (not presently shown). Preferably, the exit passage 260 terminates into a generally planar-surfaced coupling. Furthermore, a breather 270 is coupled between the coupling and the hollow interior 216 so that the pressure in the interior 216 does not become a vacuum relative to ambient pressure. In one alternative embodiment, the breather 270 is embodied as a hollow tube that is coupled between an air hole in the generally planar mounting/coupling, and the hollow portion of the handle 216. At this point it can be seen that the hollow interior 216 is separated from the 250 via a radial lip 217, which is of a radius smaller than that of the pump chamber 250. A cavity 218 traverses the length of the radial lip 217 from the hollow interior 216 to the side nearest to the pump chamber 250, and is in alignment with the breather pipeline 317. Preferably, the cavity 218 is about radially as large as the breather pipeline 317, however, any cavity radius is acceptable as long as it will allow the air pressure in the hollow interior 216 to stabilize at approximately ambient pressure, while allowing a minimal amount (preferably, none) of a desired liquid to travel through the breather pipeline 317. Of course, many alternatives to the breathers shown and described herein are readily apparent to those of ordinary skill in the art, and are accordingly encompassed within the scope of the invention as defined in the claims.

Accordingly, referring again to FIG. 2, the pump chamber 250 may also comprise the pump button 150, which may also comprise part of the hollow interior 210. The first pump cylinder has a first volume when the pump button 150 is at rest, and a second volume when the pump button 150 is in a depressed position (the second volume being less than the first volume). The exit passage 260 is preferably a tubular shaped portion of the housing 110 that traverses from the second pump cylinder 300 to a coupling portion of the housing. However, it should be understood that the exit passage may have any shape and is limited only by its function of providing a passage for liquid to travel from inside the hollow portion of the handle to outside the hollow portion of the handle.

Figure 4:
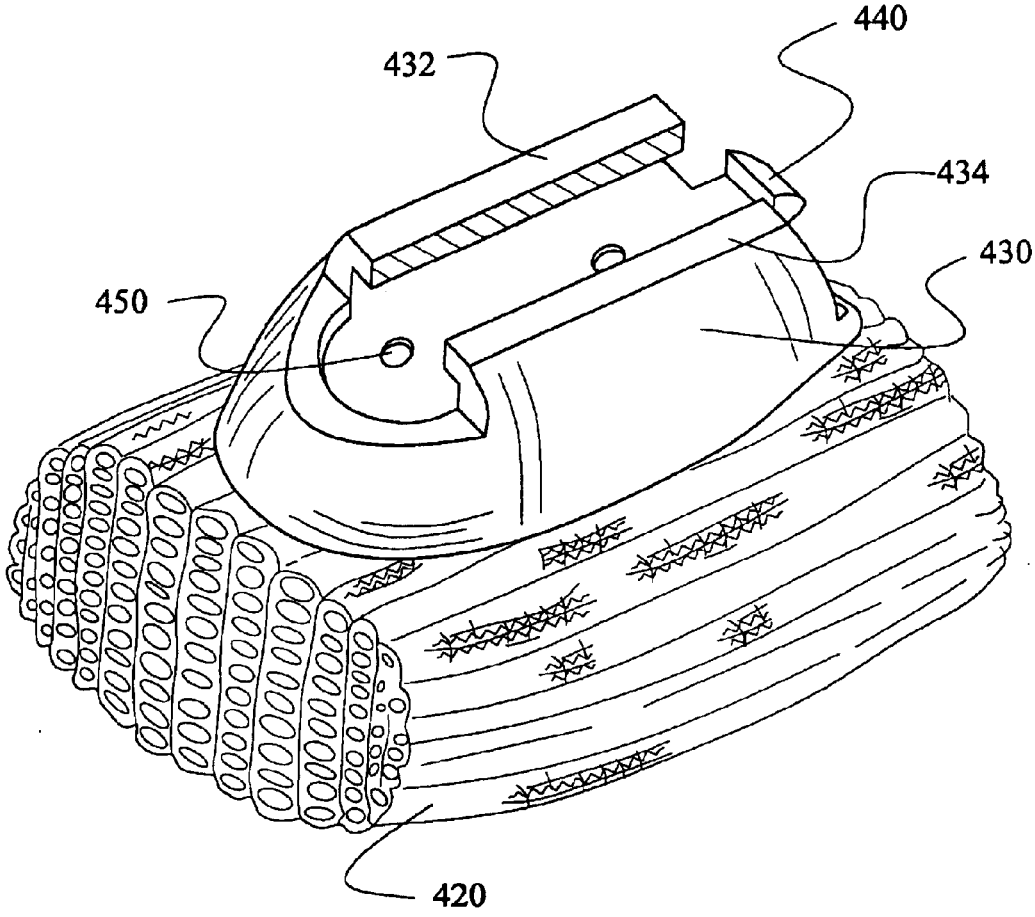
FIG. 4 illustrates a coupling member attached to a soft attachment.
Figure 5:
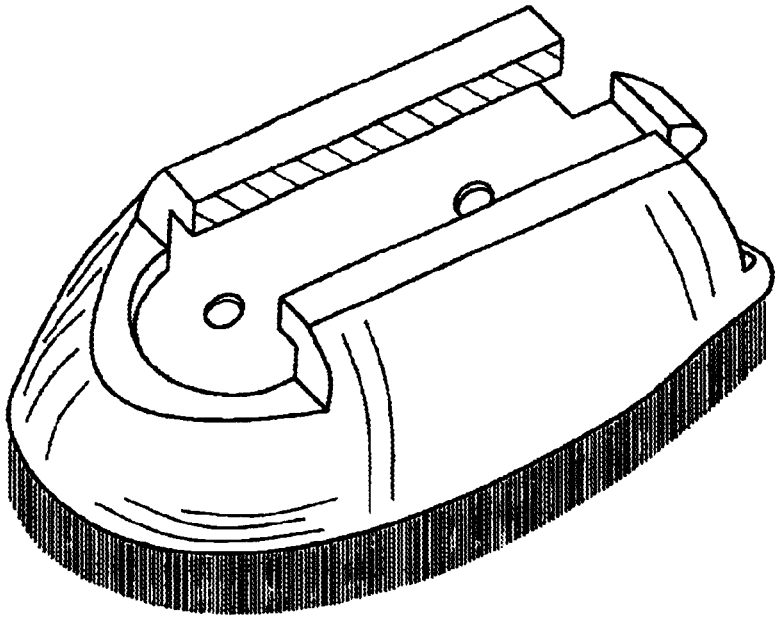
FIG. 5 shows a soft attachment with bristles.

FIG. 4 illustrates a coupling member 430 attached to a soft attachment 420, embodied as a soft sponge. The coupling member 430 is attachable to a coupling comprising a generally planar mounting that is adapted to secure within the frame of the coupling member 430 via a first rail 432 and a second rail 434, and is securable via a latch 440, as is readily apparent to those of ordinary skill in the art. Holes 450 allow for a soft screw or other attaching coupling to secure the soft attachment 420 to the coupling member 430. Of course, many alternatives for coupling the soft members to the hollow handle exist, such as a clip, magnets, or VELCRO®, for example, and these alternatives do not depart from the scope or spirit of the claims.

Though the invention has been described with respect to a specific preferred embodiment, many variations and modifications will become apparent to those skilled in the art upon reading the present application. It is therefore the intention that the appended claims be interpreted as broadly as possible in view of the prior art to include all such variations and modifications.

We claim:

1. A soap dispenser, comprising:

a handle comprising a hollow interior chamber, and a coupling on a first end of the handle, the first end also having a fluid passage, the fluid passage adapted to transfer a liquid soap from the hollow interior to outside the hollow interior, a portion of the fluid passage being sufficiently narrow to prevent the free-flow of the liquid soap to the outside of the hollow interior; and a soft attachment having a coupling member that is removably attachable to the coupling of the handle such that the coupling member does not block the fluid passage; wherein the hollow interior of the handle comprises a first end and a second end, and wherein the hollow interior maintains a first valve that separates the hollow interior into a fluid portion at the second end, and a pump chamber at the first end, the first valve allows fluid to traverse from the hollow interior into the pump chamber and to the fluid passage, wherein the coupling comprises a generally planar mounting having a first hole for allowing the liquid to traverse through an exit passage and into the soft attachment; and a breather pipeline coupled and extending between in the generally planar mounting and the hollow interior chamber.

2. The soap dispenser of claim 1 further comprising the liquid soap in the hollow interior chamber.

3. The soap dispenser of claim 1 wherein the soft attachment comprises a poof ball.

4. The soap dispenser of claim 1 wherein the soft attachment comprises soft bristles.

5. The soap dispenser of claim 1 wherein the soft attachment comprises a soft sponge.

6. The soap dispenser of claim 1 wherein the soft attachment comprises a loofah.

7. The soap dispenser of claim 1 further comprising a cap on a second end of the handle, the cap being removable to allow a user to fill the hollow interior of the handle with the liquid soap.

8. The soap dispenser of claim 1 wherein the handle further comprising a grip that at least partially covers an exterior portion of the handle.

9. The soap dispenser of claim 1 wherein the coupling having a flaring-lip that is adapted to couple to the coupling member.

10. The soap dispenser of claim 1 further comprising a second valve located near the first end to separate the hollow interior into the pump chamber and an exit passage, so as to place the pump chamber between the first valve and the second valve, and wherein the second valve allows the liquid soap to traverse from the pump chamber and into the exit passage.

11. The soap dispenser of claim 9 wherein the first valve is a one-way valve.

12. The soap dispenser of claim 9 wherein the first valve is a spring-loaded ball-stop type one-way valve.

13. The soap dispenser of claim 12 wherein the pump chamber comprising a pump button defining a portion of the hollow interior, the pump button for moving the liquid soap through the pump chamber.

14. The soap dispenser of claim 13 wherein the pump button is rubber.

15. The soap dispenser of claim 13 wherein the pump chamber has a first volume when the pump button is at rest, and the pump chamber has a second volume when the pump button is in a depressed position, the second volume being less than the first volume.

16. The soap dispenser of claim 2 wherein the coupling member mounts to the coupling of the handle via a clip.

* * * * *